US005643160A

United States Patent [19]

Huang

[11] Patent Number: 5,643,160

[45] Date of Patent: Jul. 1, 1997

[54] CHEST DEVELOPER

[76] Inventor: Ma-Li Hsu Huang, No. 76-4, Chu Kwang Rd., Chungho City, Taipei Hsien, Taiwan

[21] Appl. No.: 588,883

[22] Filed: Jan. 19, 1996

[51] Int. Cl.[6] ..... A63B 21/05; A63B 23/12

[52] U.S. Cl. ..... 482/126; 482/122; 482/125

[58] Field of Search ..... 482/44, 112, 113, 482/121, 122, 125, 126, 128, 140, 908; 601/33

[56] References Cited

U.S. PATENT DOCUMENTS

| | | | |
|---|---|---|---|
| 767,008 | 8/1904 | Pelletier et al. | 482/112 |
| 4,148,479 | 4/1979 | Spector | 482/112 |
| 4,290,599 | 9/1981 | Berger | 482/126 |
| 4,351,527 | 9/1982 | Crisp, Jr. | 482/121 |
| 5,476,435 | 12/1995 | Nimmo | 482/126 |

FOREIGN PATENT DOCUMENTS

| | | | |
|---|---|---|---|
| 2106400 | 4/1983 | United Kingdom | 482/112 |

*Primary Examiner*—Jeanne M. Clark
*Attorney, Agent, or Firm*—Varndell Legal Group

[57] ABSTRACT

A chest developer which includes a cylinder having a close end made with air holes and an open end sealed with a sealing end cap; and arched fixed handle fixedly secured to the close end outside the cylinder, an arched movable handle; a piston rod having one end fixedly mounted with a piston movable in the cylinder and an opposite end extending out of the sealing end cap and fixedly secured to the arched movable handle; a compression spring mounted within the cylinder and stopped between the piston and the sealing end cap, the compression spring being compressed when the arched movable handle is pulled outwards relative to the arched fixed handle.

4 Claims, 18 Drawing Sheets

CHEST DEVELOPER

BACKGROUND AND SUMMARY OF THE INVENTION

The present invention relates to chest developers, and relates more particularly to such a chest developer which comprises a cylinder coupled to a fixed handle, a piston rod having one end mounted with a piston movable in the cylinder and an opposite end coupled to a movable handle outside the cylinder, and a compression spring mounted in the cylinder and stopped between the piston and one end of the cylinder.

A variety of chest developers have been disclosed for exercising the muscles of the hands and the chest, and have appeared on the market. FIG. 1 shows a chest developer according to the prior art which comprises two handles, and a plurality of coiled springs connected in parallel between the handles by clips. This structure of chest developer is not durable in use because the spirngs wear quickly with use. Furthermore, the user's fingers tend to be jammed in the springs during the operation. FIG. 2 shows another structure of chest developer according to the prior art, which comprises two foot plates fixedly connected together, a handle, and an elongated elastic member connected between the foot plates and the handle. This structure of chest developer is still not durable in use because the elastic member wears quickly with use. FIG. 3 shows still another structure of chest developer according to the prior art, which comprises a sleeve having handle at one end, a tube having one end inserted into the sleee and an opposite end terminating in a handle, and a compression spring mounted inside the sleeve and stopped against the tube. When in operation, the tube is forced toward the sleeve to compress the compression spring. This structure of chest developer is still not durable in use because the compression spring wears quickly with use.

The present invention has been accomplished to provide a chest developer which is durable and practical in use. According to one aspect of the present invention, the chest developer comprises a cylinder coupled to a fixed handle, a piston rod having one end mounted with a piston movable in the cylinder and an opposite end coupled to a movable handle outside the cylinder, a compression spring mounted in the cylinder and stopped between the piston and one end of the cylinder, and air holes made on the cylinder at two opposite ends. When the movable handle is moved relative to the fixed handle, the piston is reciprocated by the piston rod to draw air into the cylinder and then to force air out of the cylinder. According to another aspect of the present invention, an adjustment device is installed in the cylinder to adjust the flow rate of exhaust air so that the damping force against the movable handle can be adjusted as desired.

DETAILED DESCRIPTION OF THE PREFERRED EMBODIMENT

Figure 1:
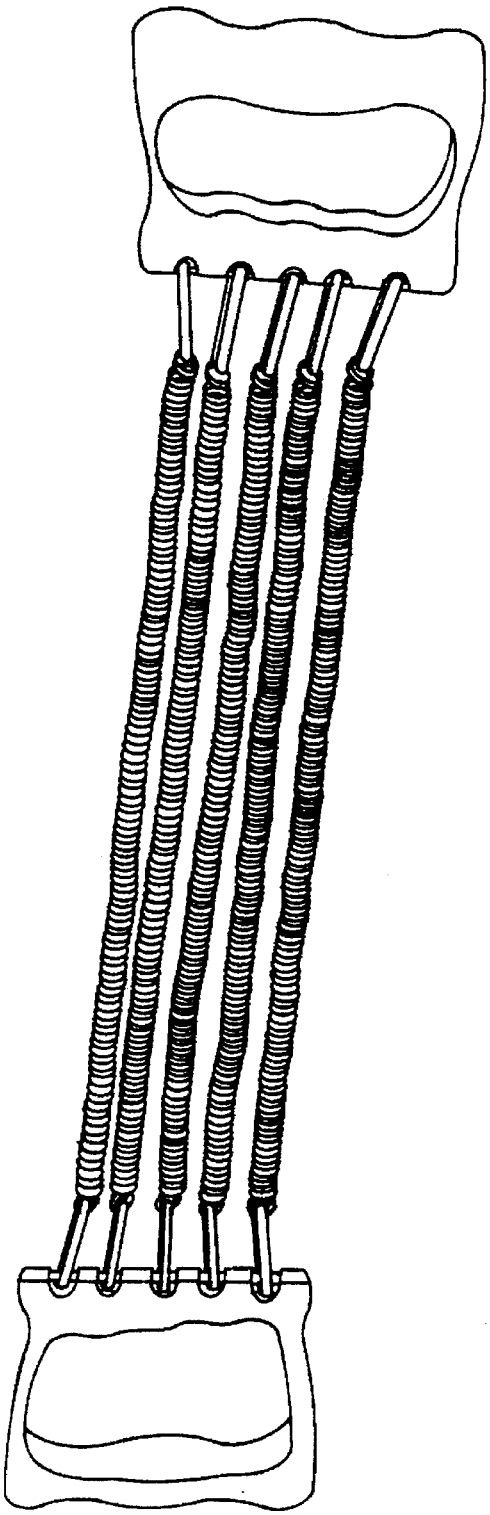
Fig.1 PRIOR ART
FIG. 1 shows a chest developer according to the prior art.
Figure 2:
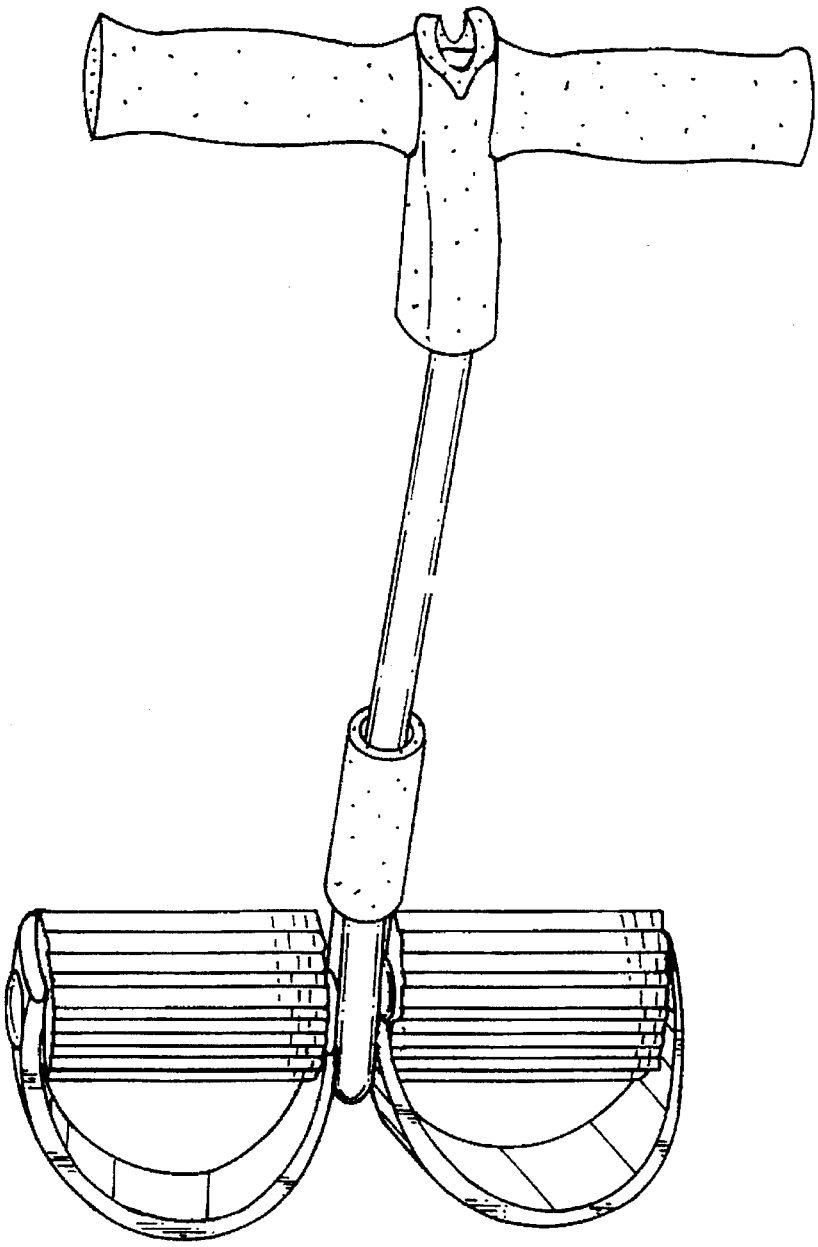
Fig. 2 PRIOR ART
FIG. 2 shows another structure of chest developer according to the prior art.
Figure 3:
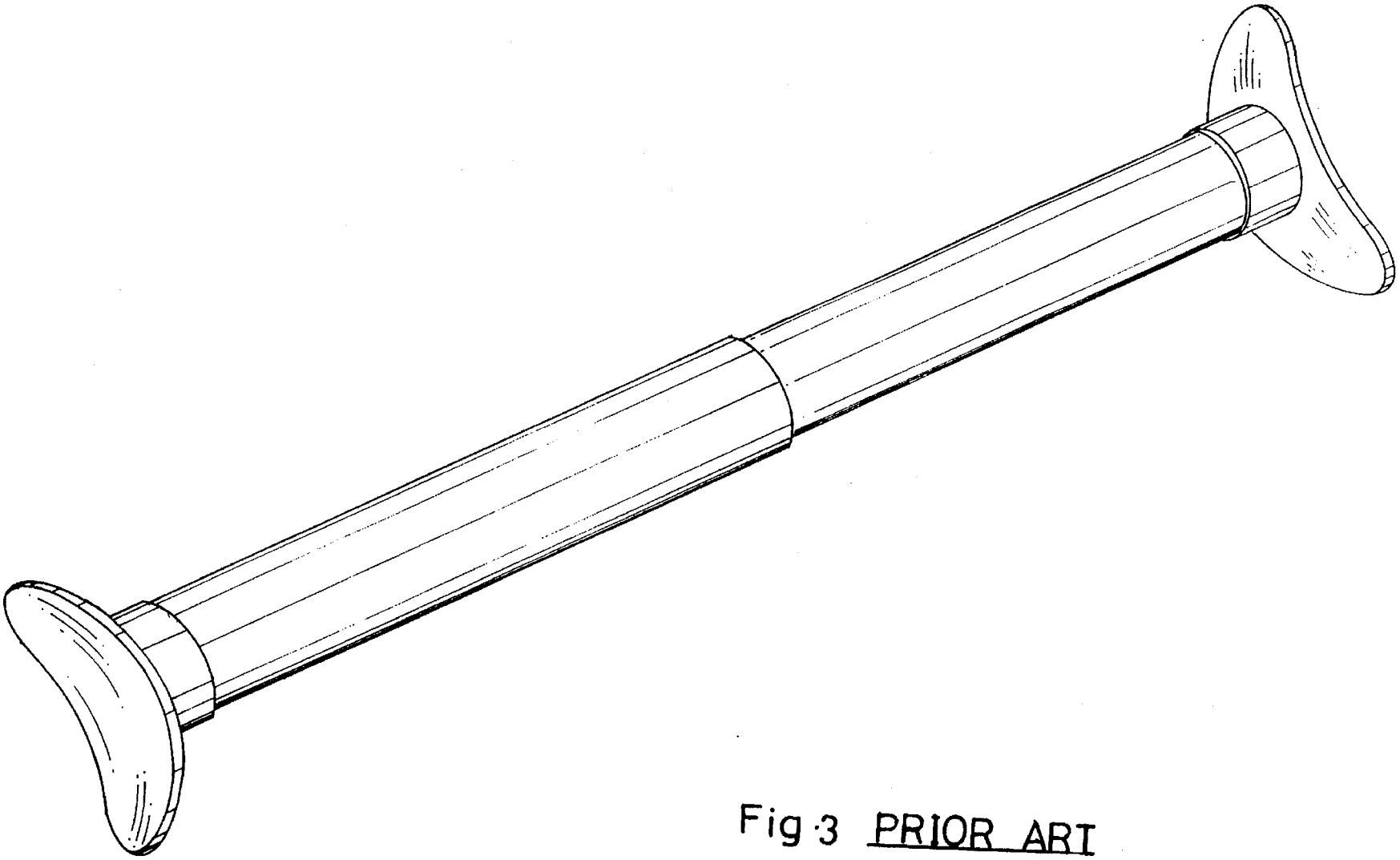
Fig 3 PRIOR ART
FIG. 3 shows still another structure of chest developer according to the prior art.
Figure 4:
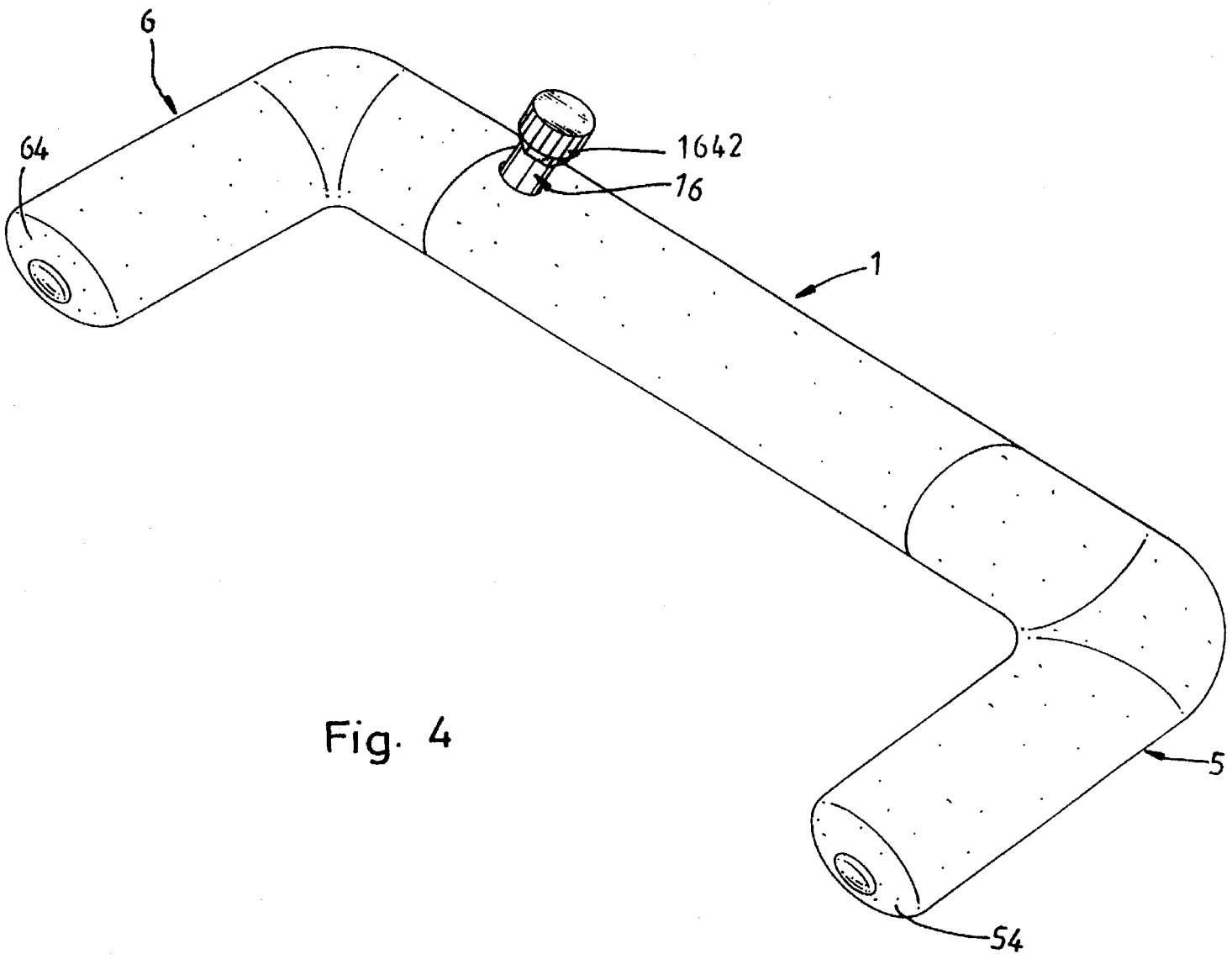
FIG. 4 is an elevational view of a chest developer according to the present invention.
Figure 5:
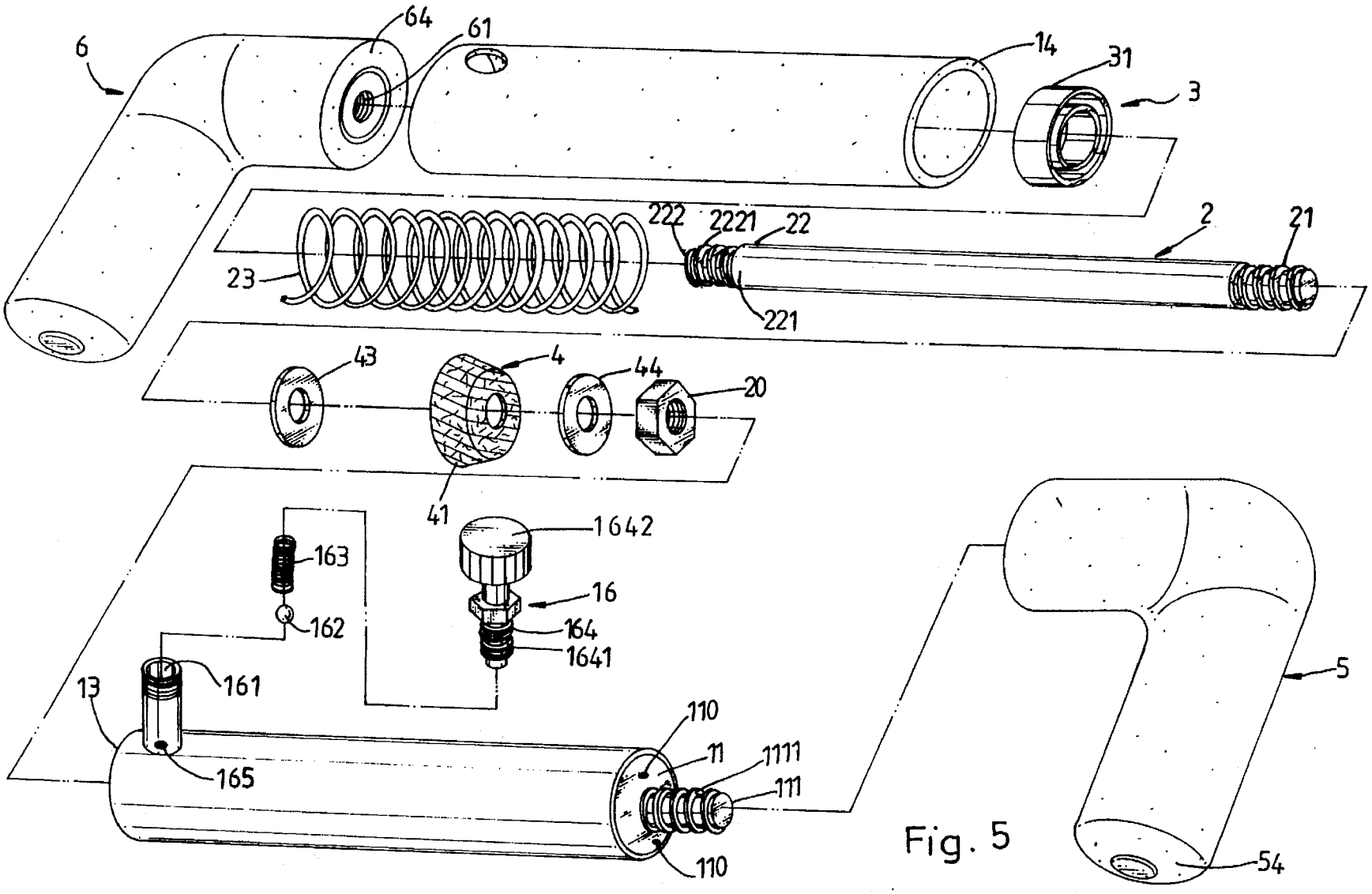
FIG. 5 is an exploded view of the chest developer shown in FIG. 4.
Figure 6:
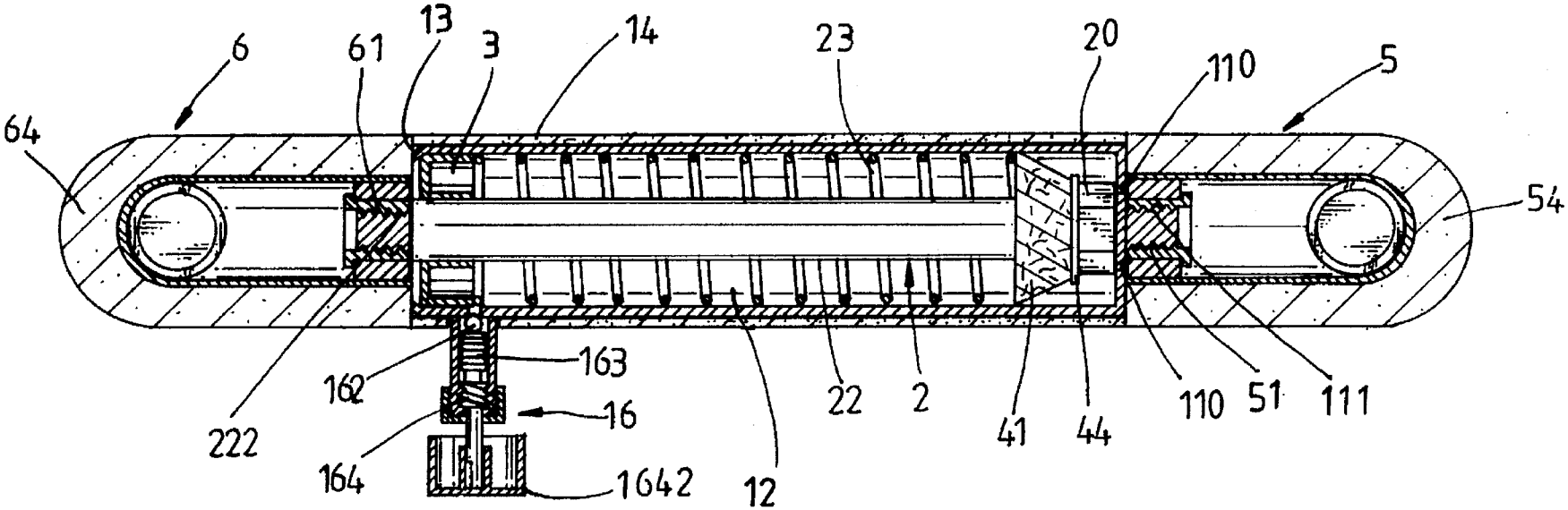
FIG. 6 is a sectional assembly view of the chest developer shown in FIG. 4.
Figure 7:
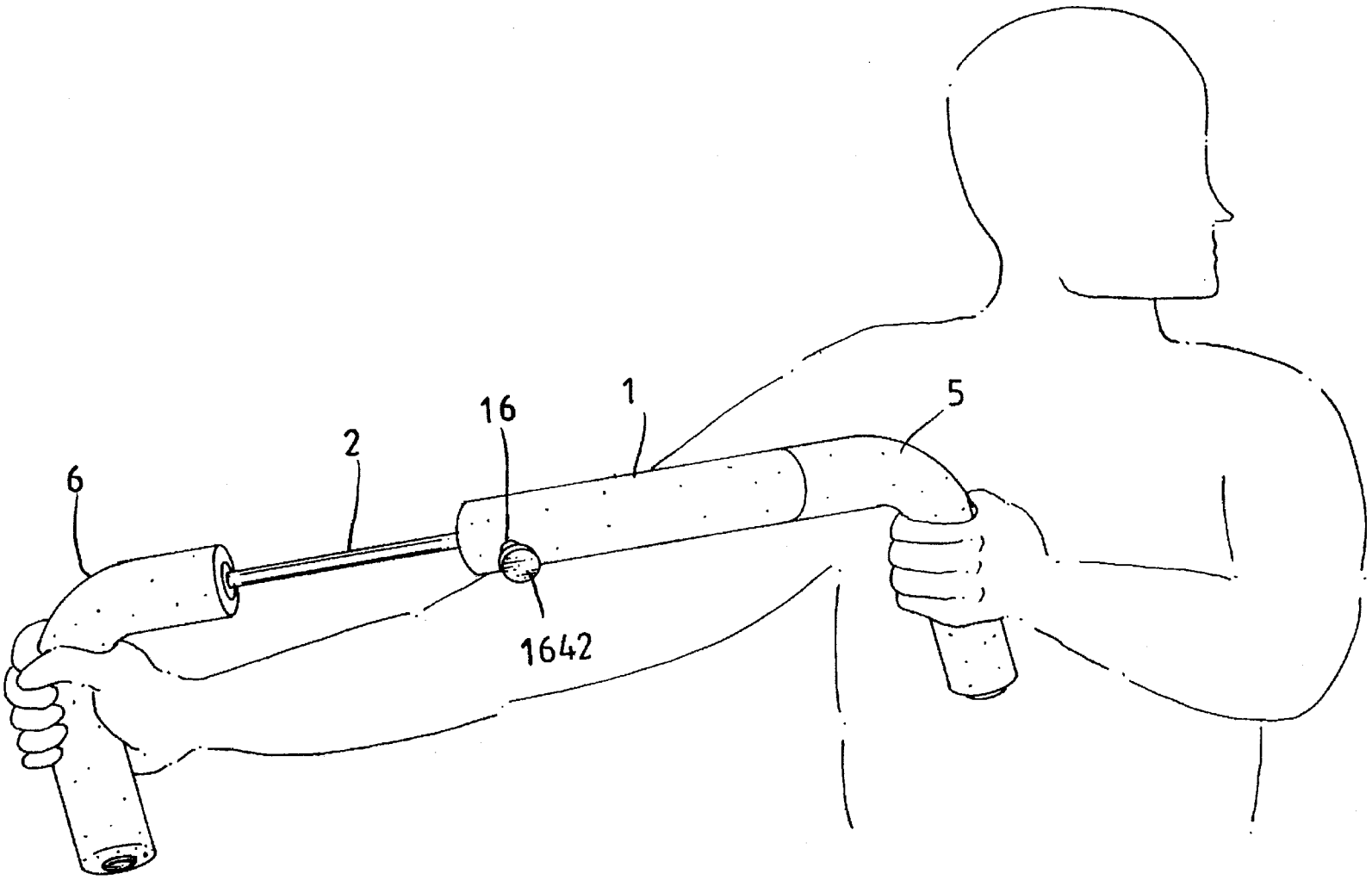
FIG. 7 shows one application example of the chest developer shown in FIG. 4.
Figure 8:
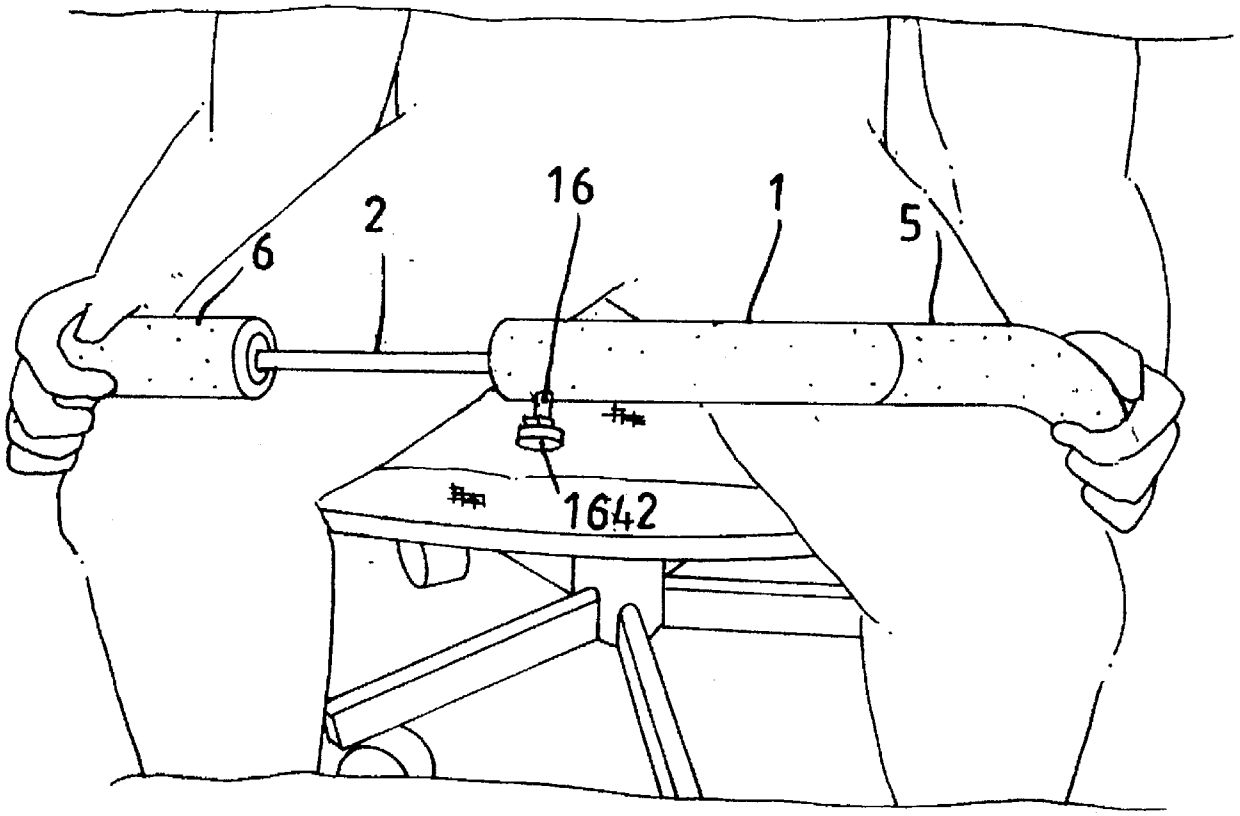
FIG. 8 shows another application example of the chest developer shown in FIG. 4.
Figure 9:
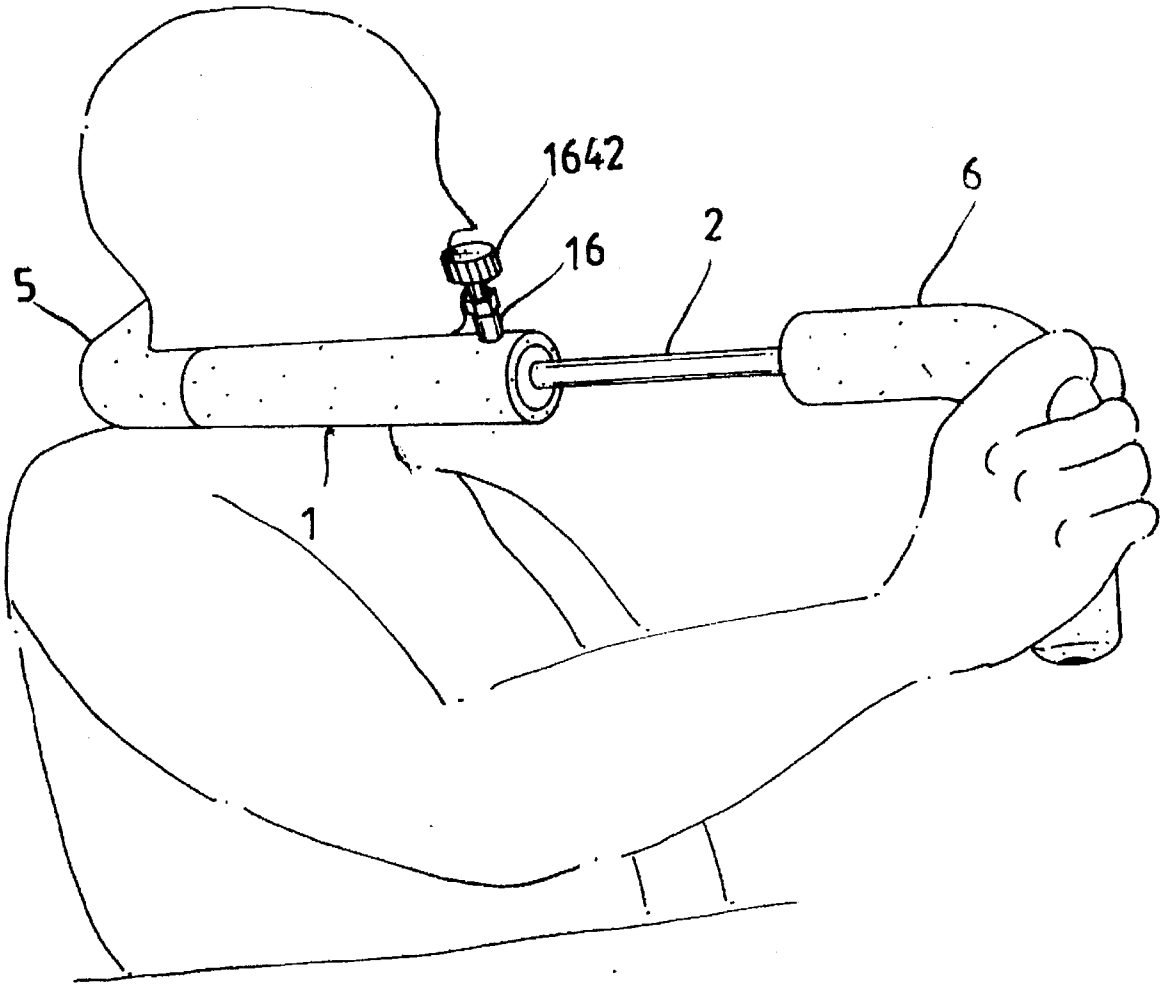
FIG. 9 shows still another application example of the chest developer shown in FIG. 4.
Figure 10:
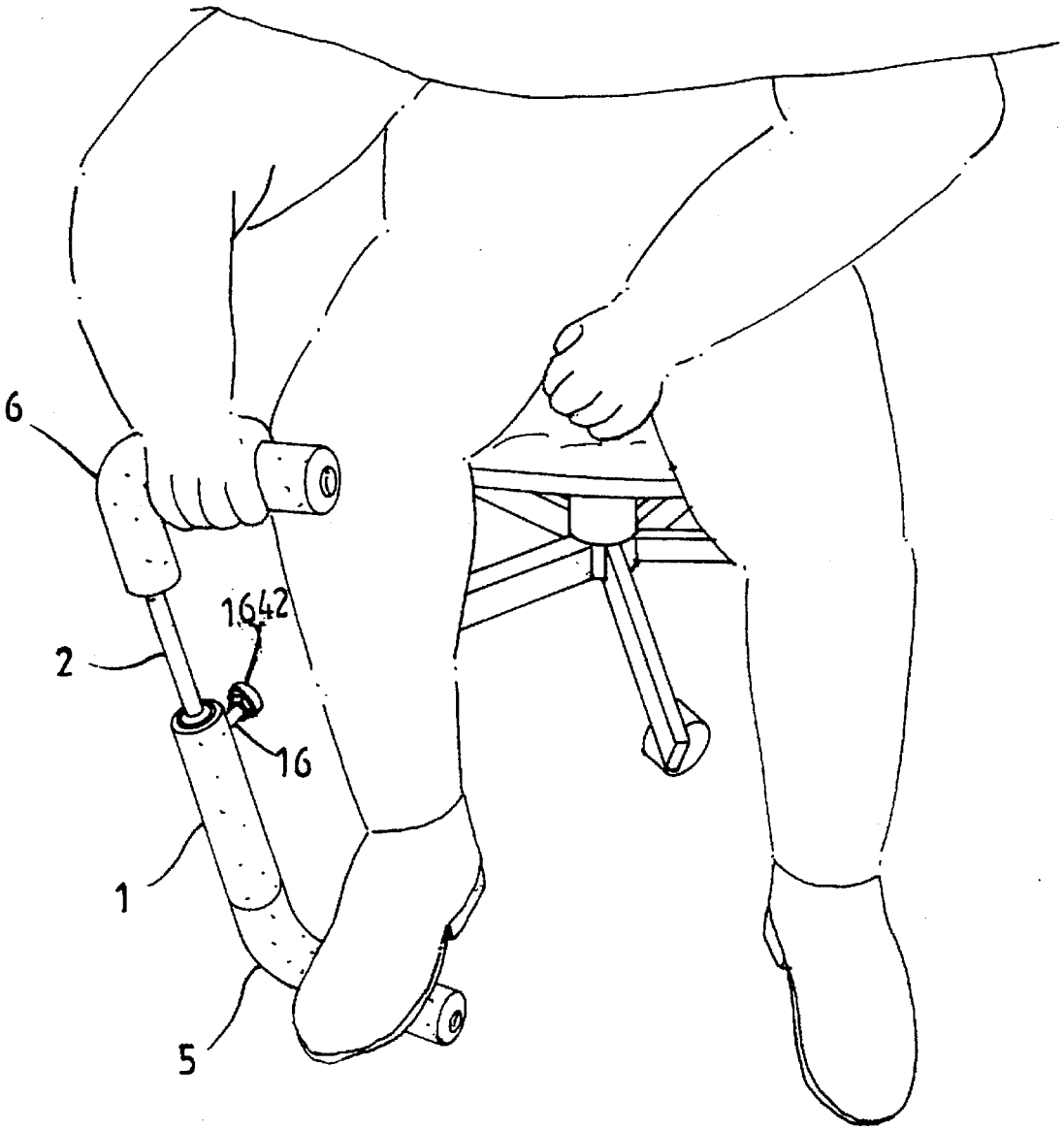
FIG. 10 shows still another application example of the chest developer shown in FIG. 4.

Referring to FIGS. 4, 5, and 6, a chest developer in accordance with the present invention is generally comprised of a cylinder 1, an arched fixed handle 5 fixedly secured to the cylinder 1 at one end, a piston rod 2, a piston 4 movable in the cylinder 1 by the piston rod 2, and an arched movable handle 6 coupled to the piston rod 2 remote from the piston 4 and disposed outside the cylinder 1. The cylinder 1 is made from rigid metal and covered with a polyurethane covering 14, comprising a close end 11, an open end 13, an axial hole 12 defined between the close end 11 and the open end 13, two air holes 110 through the close end 11, a coupling rod 111 extending outwards from the close end 11 and having an outer thread 1111, and a sealing end cap 3 fastened to the open end 13. The fixed handle 5 is covered with a polyurethane covering 54, having an inner thread 51 at one end threaded onto the outer thread 1111 of the coupling rod 111 of the cylinder 1. The piston rod 2 is inserted into the axial hole 12 of the cylinder 1, comprising a piston rod body 22 having an outer thread 21 at one end and a coupling rod section 222 with an outer thread 2221 at an opposite end 221. The coupling rod section 222 of the piston rod 2 projects out of the sealing end cap 3 of the cylinder 1. The piston 4 is fixedly secured to the outer thread 21 of the piston rod 2 by a nut 20 and two washers 43, 44, having a tapered outer wall 41. The maximum diameter of the tapered outer wall 41 of the piston 4 is slightly bigger than the diameter of the axial hole 12 of the cylinder 1. The diameter of the tapered outer wall 41 of the piston 4 gradually reduces toward the close end 11 of the cylinder 1. The movable handle 6 is covered with a polyurethane covering 64, having an inner thread 61 at one end threaded onto the outer thread 2221 of the coupling rod section 222 of the piston rod 2. A compression spring 23 is mounted inside the axial hole 12 of the cylinder 1, having one end stopped against the sealing end cap 3 and an opposite end stopped against the piston 4. An adjustment device 16 is installed in the cylinder 1 to adjust the exhaust rate of air, comprising a hollow screw holder 161 perpendicularly raised from the cylinder 1 adjacent to the open end 13, an exhaust hole 165 in the hollow screw holder 161 for exhaust of air from the axial hole 12 of the cylinder 1, a steel ball 162 mounted within the hollow screw holder 161 and forced to control the flow rate of air through the exhaust hole 165, a spring 163 mounted within the hollow screw holder 161 and stopped above the steel ball 162, and an adjusting screw 164 having a threaded stem 1641 threaded into the hollow screw holder 161 and stopped against the spring 163 and a head 1642 at the top end of the threaded stem 1641 for turning by hand. By turning the head 1642 forwards or backwards, the flow rate of air through the exhaust hole 165 is adjusted.

Referring to FIGS. from 6 to 10, when the movable handle 6 is pulled outwards relative to the fixed handle 5, the piston rod 2 is pulled to force the piston 4 against the compression spring 23, causing the compression spring 23 compressed. When the movable handle 6 is released, the compression spring 23 forces the piston 4 backwards toward the close end 11 of the cylinder 1, and therefore the movable handle 6 is moved backwards by the piston rod 2 to closely stop at the outer end 31 of the sealing end cap 3.

Figure 11:
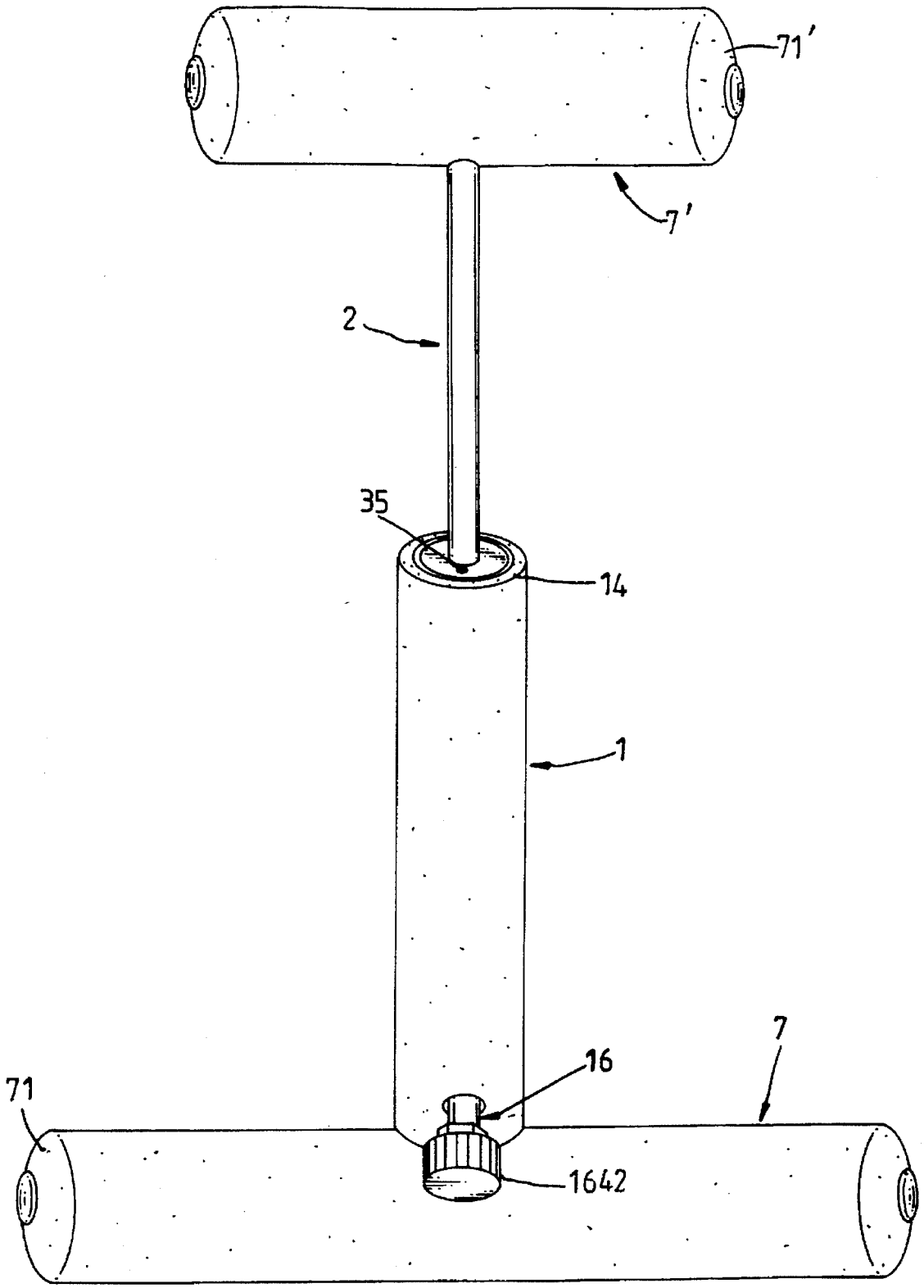
FIG. 11 is an elevational view of an alternate form of the chest developer according to the present invention.
Figure 12:
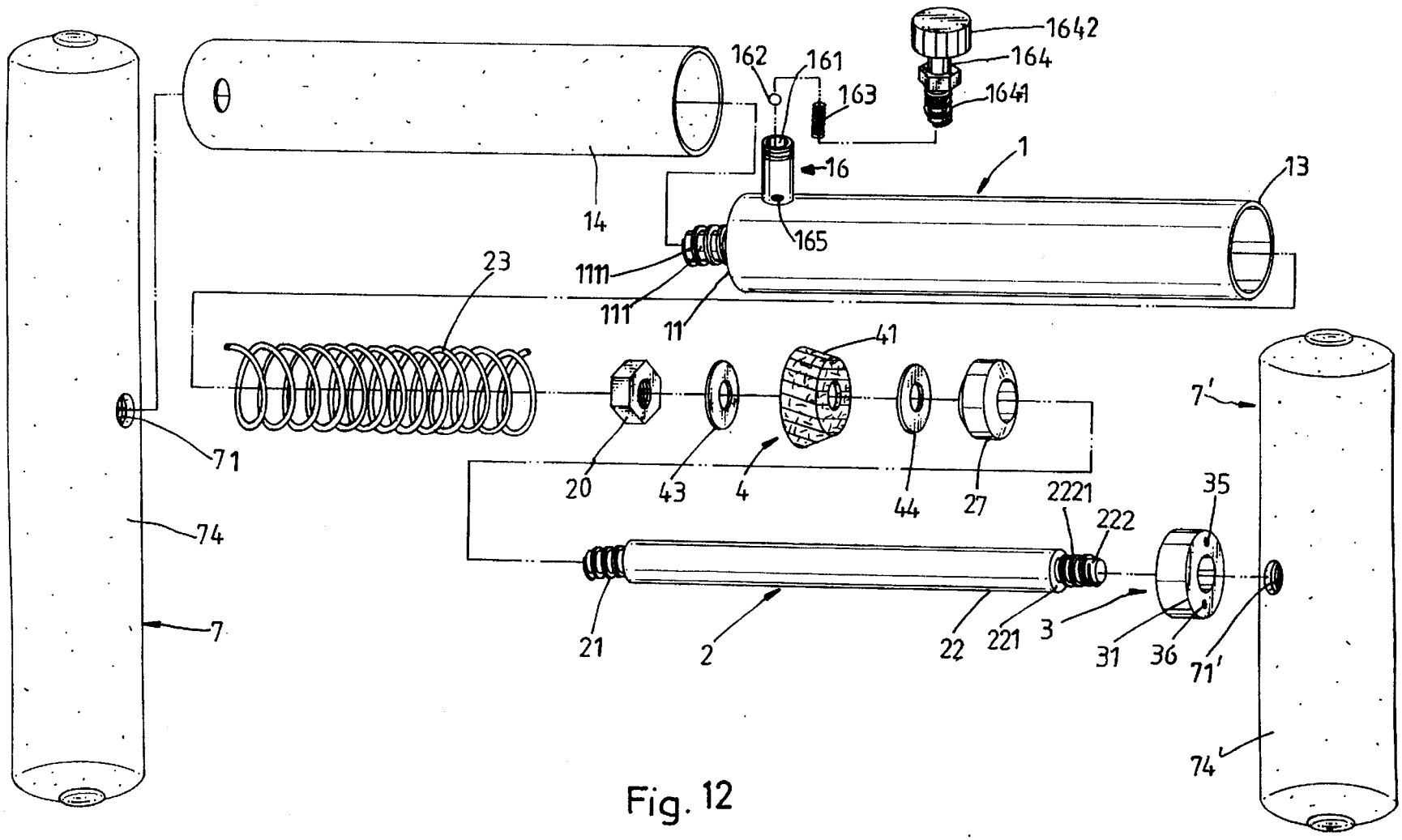
FIG. 12 is an exploded view of the chest developer shown in FIG. 11.
Figure 13:
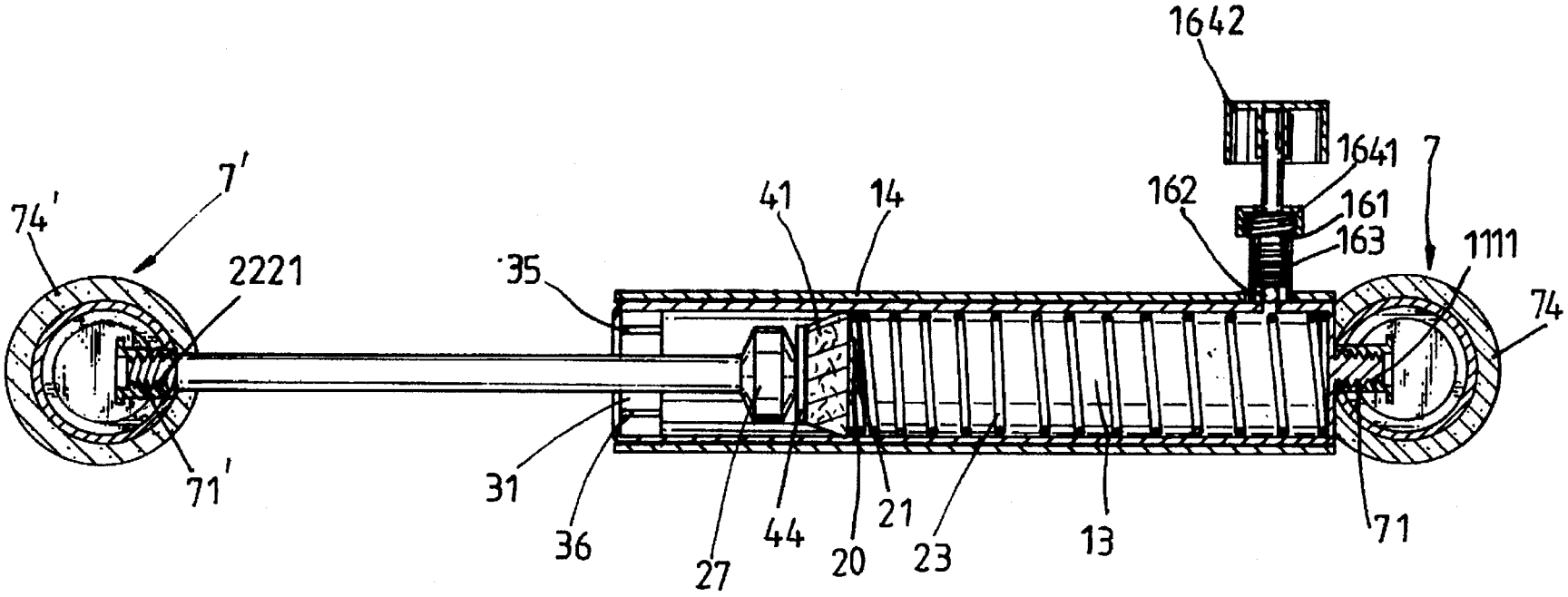
FIG. 13 is a sectional assembly view of the chest developer shown in FIG. 11.
Figure 14:
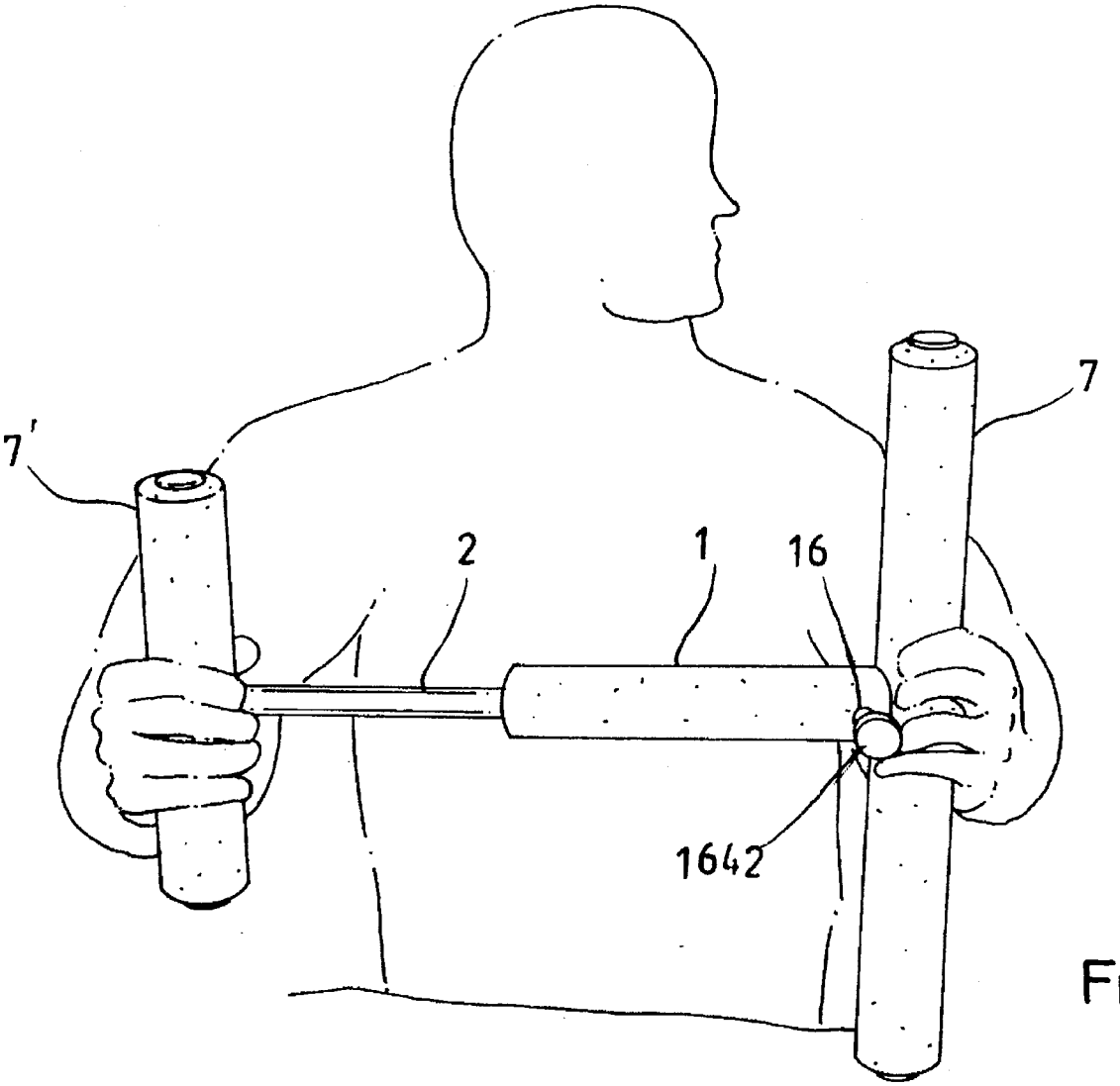
FIG. 14 shows an application example of the chest developer shown in FIG. 11.
Figure 15:
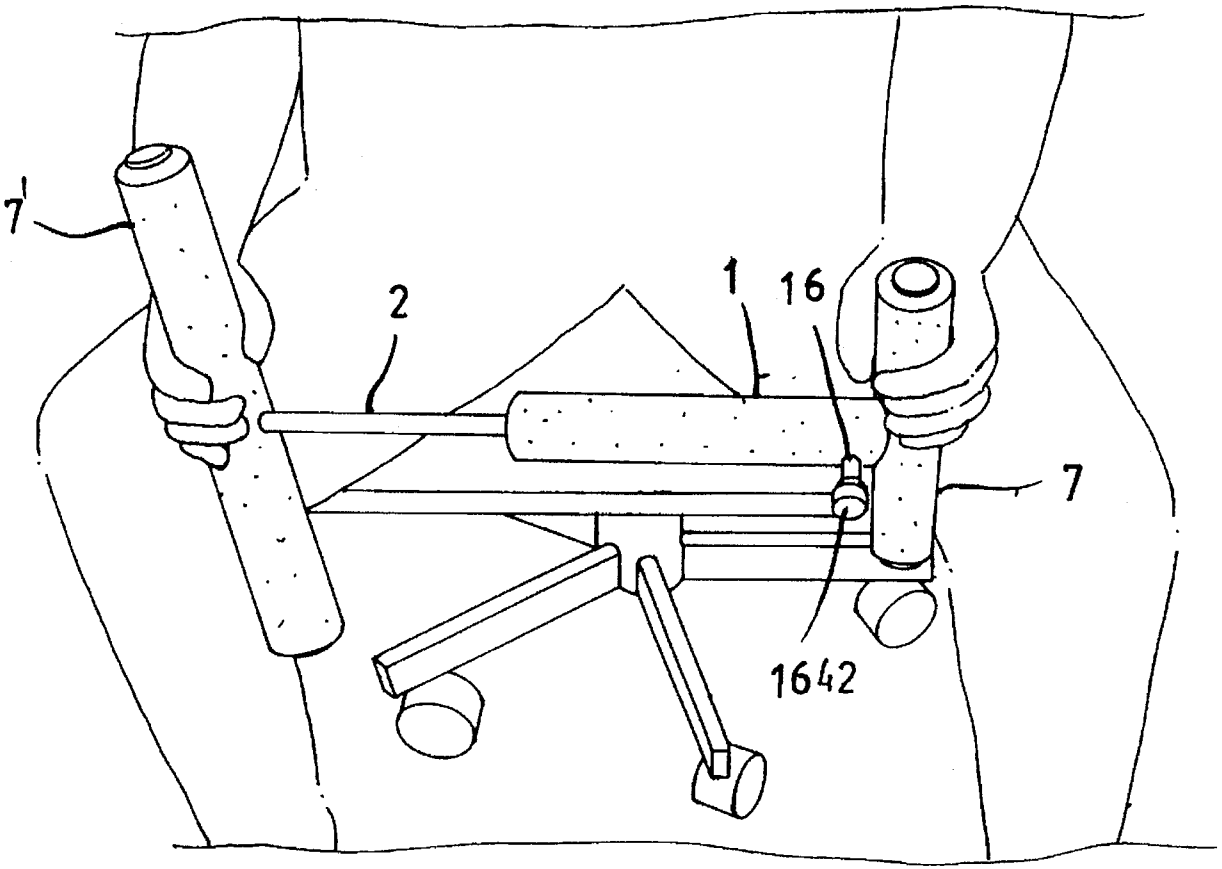
FIG. 15 shows another application example of the chest developer shown in FIG. 11.
Figure 16:
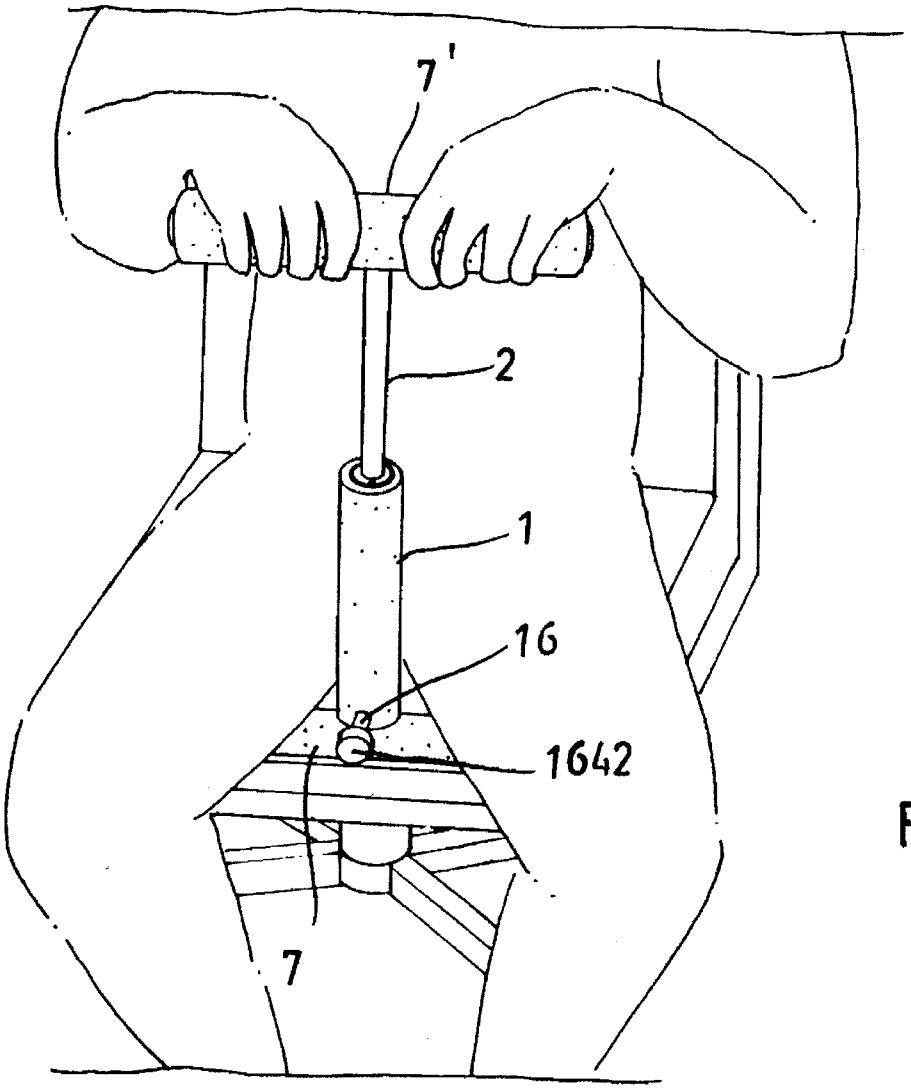
FIG. 16 shows still another application example of the chest developer shown in FIG. 11.
Figure 17:
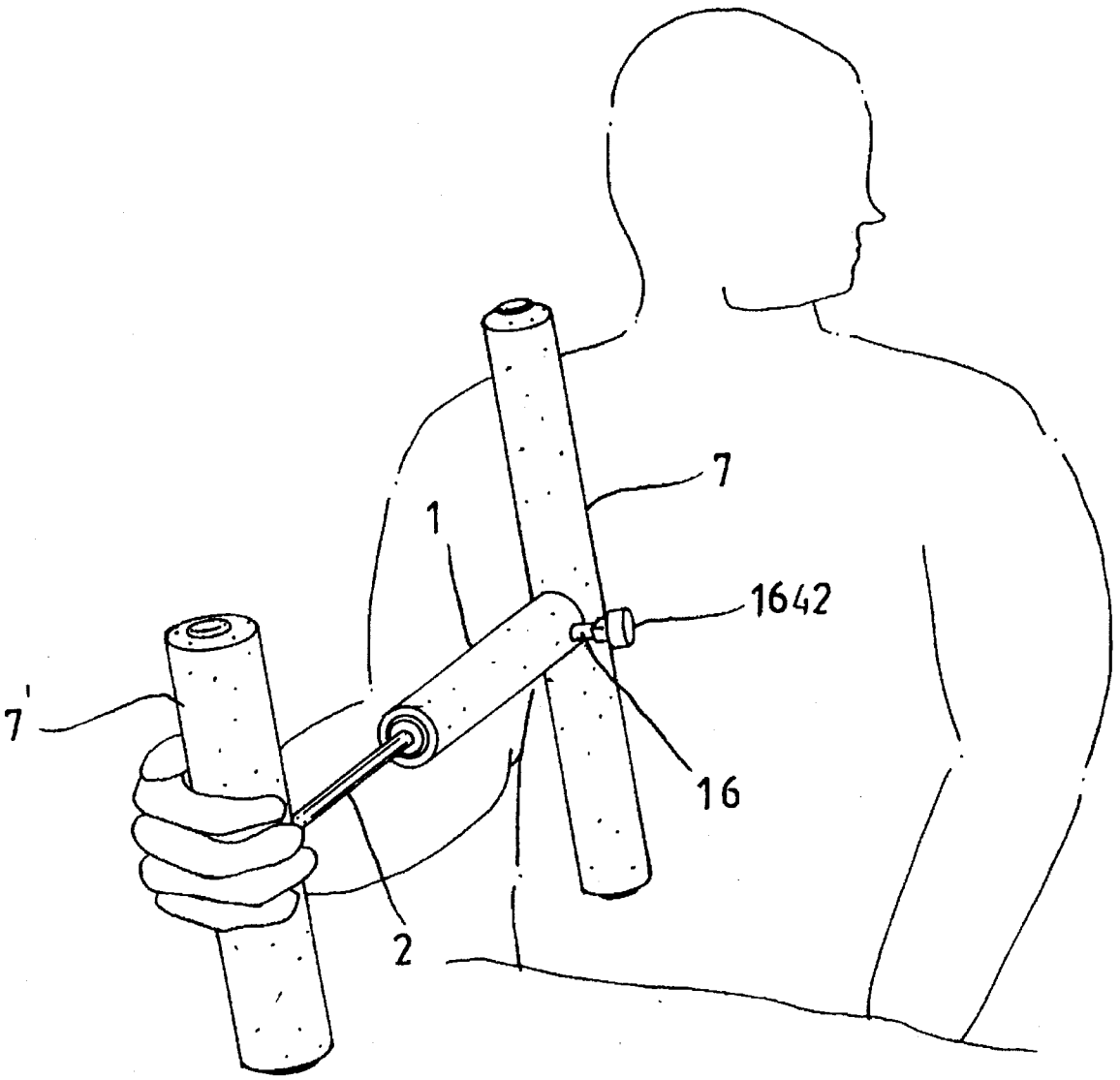
FIG. 17 shows still another application example of the chest developer shown in FIG. 11.
Figure 18:
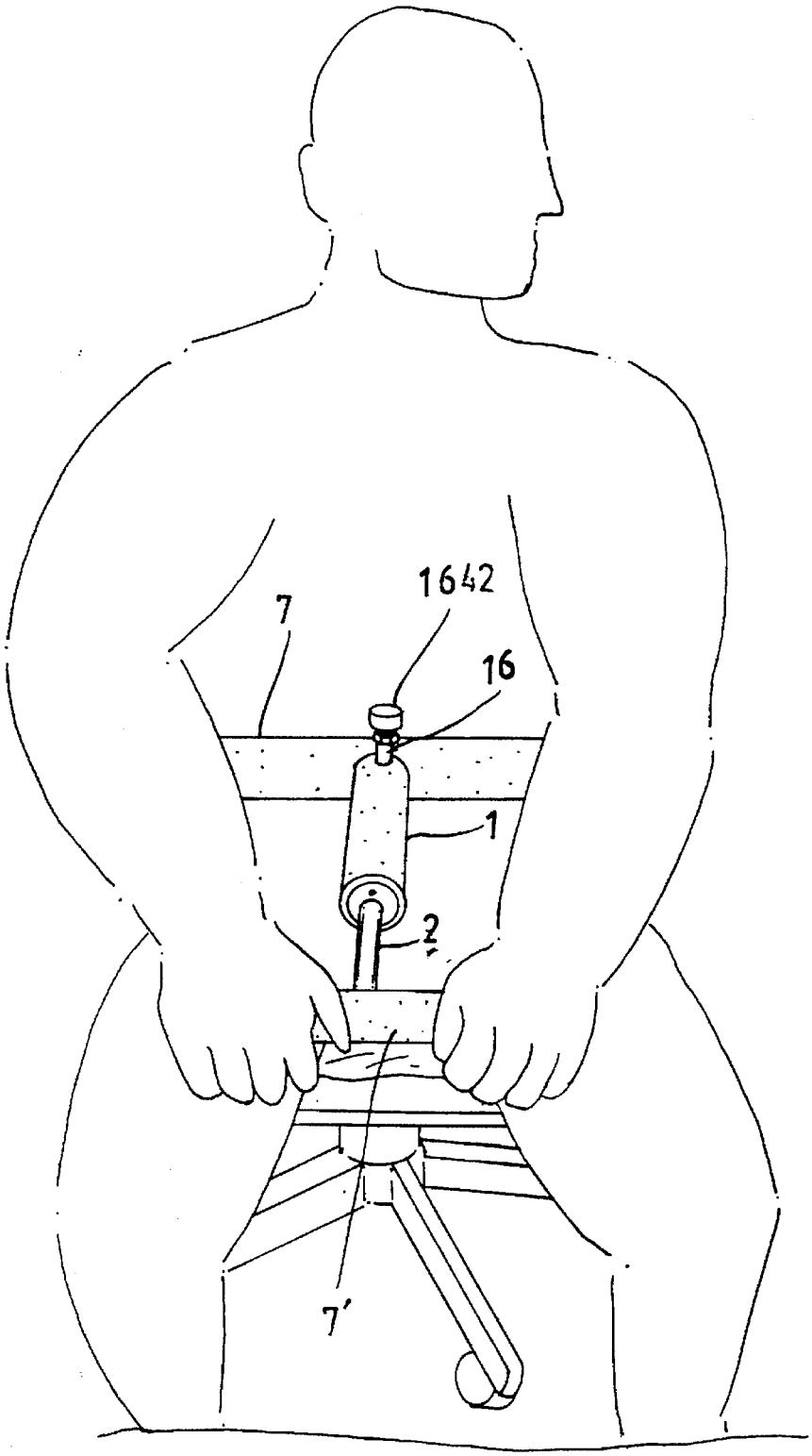
FIG. 18 shows still another application example of the chest developer shown in FIG. 11.

FIGS. 11, 12, 13 shows an alternate form of the present invention. According to this alternate form, the chest developer comprises a cylinder 1, a straight fixed handle 7 fixedly secured to the cylinder 1 at one end, a piston rod 2, a piston 4 moved in the cylinder 1 by the piston rod 2, a straight movable handle 7' coupled to the piston rod 2 remote from the piston 4 and disposed outside the cylinder 1, a compression spring 23 mounted inside the cylinder 1 and stopped against the piston 4, and an adjustment device 16 for regulating the flow rate of exhaust air from the cylinder 1, wherein the cylinder 1 is made from rigid metal and covered with a polyurethane covering 14, comprising a close end 11, an open end 13, an axial hole 12 defined between the close end 11 and the open end 13, a coupling rod 111 extending outwards from the close end 11 and having an outer thread 1111, and a sealing end cap 3 fastened to the open end 13, the sealing end cap 3 having an outer side 31 and two air holes 35, 36 through the outer side 31 in communication with the axial hole 12; the straight fixed handle 7 is covered with a polyurethane covering 74, having an inner thread 71 in the middle threaded onto the outer thread 1111 of the coupling rod 111 of the cylinder 1; the piston rod 2 is inserted into the axial hole 12 of the cylinder 1, comprising a piston rod body 22 having an outer thread 21 at one end fastened with nuts 20, 27 and washers 43, 44 to hold the piston 4, which has a tapered outer wall 41 gradually reducing toward the sealing end cap 3, and a coupling rod section 222 with an outer thread 2221 at an opposite end 221 projecting out of the sealing end cap 3; the straight movable handle 7' is covered with a polyurethane covering 74', having an inner thread 71' in the middle threaded onto the outer thread 2221 of the coupling rod section 222 of the piston rod 2; the compression spring 23 is mounted inside the axial hole 12 of the cylinder 1, having one end stopped against the close end 11 of the cylinder and an opposite end stopped against the piston 4; the adjustment device 16 is installed in the cylinder 1 to adjust the exhaust rate of air, comprising a hollow screw holder 161 perpendicularly raised from the cylinder 1 adjacent to the close end 11, an exhaust hole 165 in the hollow screw holder 161 for exhaust of air from the axial hole 12 of the cylinder 1, a steel ball 162 mounted within the hollow screw holder 161 and forced to control the flow rate of air through the exhaust hole 165, a spring 163 mounted within the hollow screw holder 161 and stopped above the steel ball 162, and an adjusting screw 164 having a threaded stem 1641 threaded into the hollow screw holder 161 and stopped against the spring 163 and a head 1642 at the top end of the threaded stem 1641 for turning by hand. By turning the head 1642 forwards or backwards, the flow rate of air through the exhaust hole 165 is adjusted.

Referring to FIG. from 14 to 18, when the movable handle 7' is pushed inwards toward the fixed handle 7, the piston rod 2 is moved to force the piston 4 against the compression spring 23, causing the compression spring 23 compressed, and at the same time air is forced out of the axial hole 12 of the cylinder 1 through the exhaust hole 165. When the movable handle 7' is released, the compression spring 23 forces the piston 4 outwards toward the sealing end cap 3 of the cylinder 1.

I claim:

1. A chest developer comprising:

a cylinder made from rigid metal and covered with a polyurethane covering, said cylinder comprising a close end at one end, an open end at an opposite end, an axial hole defined between said close end and said open end, a coupling rod extending outwards from said close end and having an outer thread, and two air holes through said close end for permitting outside air to be drawn into said axial hole;

an arched fixed handle covered with a polyurethane covering, having an inner thread at one end threaded onto the outer thread of the coupling rod of said cylinder;

an arched movable handle covered with a polyurethane covering, having an inner thread at one end;

a piston rod inserted into the axial hole of said cylinder and reciprocated by said arched movable handle, said piston rod comprising an outer thread at one end fastened with a nut and a pair of washers to hold a piston, and a second outer thread at an opposite end threaded into the inner thread of said arched movable handle, said piston having a tapered outer wall gradually reducing toward the close end of said cylinder;

a sealing end cap mounted around said piston rod and fixedly secured to the open end of said cylinder;

a compression spring mounted within the axial hole of said cylinder and stopped between said piston and said sealing end cap, said compression spring being compressed when said arched movable handle is pulled outwards relative to said arched fixed handle.

2. The chest developer of claim 1 further comprising an adjustment device installed in said cylinder to adjust the exhaust rate of air from said cylinder upon reciprocation of said piston, said adjustment device comprising a hollow screw holder perpendicularly raised from said cylinder adjacent to said open end, an exhaust hole in said hollow screw holder for exhaust of air from the axial hole of said cylinder, a steel ball mounted within said hollow screw holder and forced to control the flow rate of air through said exhaust hole, a spring mounted within said hollow screw holder and stopped above said steel ball, and an adjusting screw having a threaded stem threaded into said hollow screw holder and stopped against said spring element and a head for turning said threaded stem to regular the flow rate of air through said exhaust hole by hand.

3. A chest developer comprising:

a cylinder made from rigid metal and covered with a polyurethane covering, said cylinder comprising a close end at one end, an open end at an opposite end, an axial hole defined between said close end and said open end, a coupling rod extending outwards from said close end and having an outer thread;

a straight fixed handle covered with a ployurethane covering, having an inner thread in the middle threaded onto the outer thread of the coupling rod of said cylinder;

a straight movable handle covered with a polyurethane covering, having an inner thread in the middle;

a piston rod inserted into the axial hole of said cylinder and reciprocated by said straight movable handle, said piston rod comprising an outer thread at one end fastened with a pair of nuts and a pair of washers to hold a piston, and a second outer thread at an opposite end threaded into the inner thread of said straight movable handle, said piston having a tapered outer wall gradually reducing toward the open end of said cylinder;

a sealing end cap mounted around said piston rod and fixedly secured to the open end of said cylinder, said sealing end cap having two air holes for permitting outside air be drawn into the axial hole of said cylinder upon reciprocation of said piston; and a compression spring mounted within the axial hole of said cylinder and stopped between said piston and the close end of said cylinder, said compression spring being compressed when said straight movable handle is moved toward said straight fixed handle.

4. The chest developer of claim 3 further comprising an adjustment device installed in said cylinder to adjust the exhaust rate of air from said cylinder upon reciprocation of said piston, said adjustment device comprising a hollow screw holder perpendicularly raised from said cylinder adjacent to said close end, an exhaust hole in said hollow screw holder for exhaust of air from the axial hole of said cylinder, a steel ball mounted within said hollow screw holder and forced to control the flow rate of air through said exhaust hole, a spring mounted within said hollow screw holder and stopped above said steel ball, and an adjusting screw having a threaded stem threaded into said hollow screw holder and stopped against said spring element and a head for turning said threaded stem to regular the flow rate of air through said exhaust hole by hand.

* * * * *